United States Patent [19]

Troup et al.

[11] Patent Number: 4,551,710

[45] Date of Patent: Nov. 5, 1985

[54] METHOD AND APPARATUS FOR REPORTING DANGEROUS CONDITIONS

[75] Inventors: Alan P. Troup, Männedorf; Hannes Güttinger, Stäfa; Gustav Pfister, Uetikon, all of Switzerland

[73] Assignee: Cerberus AG, Männedorf, Switzerland

[21] Appl. No.: 602,127

[22] Filed: Apr. 19, 1984

[30] Foreign Application Priority Data

Apr. 29, 1983 [CH] Switzerland ..... 2375/83

[51] Int. Cl.[4] ..... G08B 26/00

[52] U.S. Cl. ..... 340/505; 340/518; 340/825.54; 343/6.8 R

[58] Field of Search ..... 340/505, 500, 506, 518, 340/825.52, 825.54, 825.07–825.13; 343/6.5 R, 6.5 LC, 6.5 SS, 6.8 LC

[56] References Cited

U.S. PATENT DOCUMENTS

| | | | |
|---|---|---|---|
| 3,508,260 | 4/1970 | Stein | 340/505 |
| 3,623,003 | 11/1971 | Hewitt | 340/825.54 |
| 4,056,815 | 11/1977 | Anderson | 340/539 |
| 4,232,308 | 11/1980 | Lee et al. | 340/539 |
| 4,423,410 | 12/1983 | Galvin et al. | 340/505 |
| 4,477,809 | 10/1984 | Bose | 340/825.54 |

FOREIGN PATENT DOCUMENTS

| | | |
|---|---|---|
| 2415406 | 8/1979 | France . |
| 2060965 | 5/1981 | United Kingdom . |

OTHER PUBLICATIONS

World Intellectual Property Organization: (Inventor: Hackett, Kenneth), International Publication No. WO 82/00910–Publication Date 3–18–82.

*Primary Examiner*—Donnie L. Crosland
*Attorney, Agent, or Firm*—Werner W. Kleeman

[57] ABSTRACT

In an alarm system a central signal station periodically transmits interrogation signals, preferably in the form of infrared radiation packets to remotely located detectors which transmit a response signal back to the central signal station after differing time delays that are characteristic for the individual detectors and which permit the localization of the source of the response signal. In an alarm state, the detectors respond to every interrogation signal, in the normal operational state to only every $m^{th}$ interrogation signal, i.e. less often, and in a state of diminishing battery potential to only every small $p^{th}$ interrogation signal, i.e. even less often. The state of the individual detectors is determined from the frequency with which the response signals are transmitted back by the detectors, that is the ratio of the response signals to the interrogation signals.

11 Claims, 4 Drawing Figures

METHOD AND APPARATUS FOR REPORTING DANGEROUS CONDITIONS

BACKGROUND OF THE INVENTION

The present invention broadly relates to a method and apparatus for reporting dangerous or other desired conditions and, more specifically, pertains to a new and improved method and apparatus for transmitting signals in an alarm system.

Generally speaking, the method of the present invention for signal transmission and signal processing in an alarm system comprising a central signal station and remotely located detectors is intended to be employed in a system in which the central signal station transmits an interrogation signal to the detectors and the detectors transmit response or status signals back to the central signal station after receiving the interrogation signal and with a time delay characteristic of each individual detector, the response signals corresponding to the current state of the individual detector and the central signal station receiving and evaluating the response signals.

The apparatus of the present invention relates to a device for reporting danger or other desired conditions which comprises a central signal station and remotely located detectors, in which the central signal station further includes a signal transmitter for transmitting interrogation signals and each of the detectors further includes a signal receiver for receiving the interrogation or scan signals, a signal transmitter for transmitting response or status signals, a sensor for influencing the response or status signals and delay means for temporally delaying the transmission of the response or status signals in relation to the reception of a interrogation signal by different delay times characteristic of each individual detector. The central signal station further includes a signal receiver for receiving the response or status signals transmitted by the individual detectors.

The detectors or danger reporting devices can be constructed to respond to the conditions to be expected and to be reported for a given application and may comprise corresponding sensors, sensitive for instance to fire, smoke, flames or prescribed gases or also to intrusion and theft.

Such methods and apparatuses are known, for instance from the German patent No. 2,533,330. They permit the determination of the source of the response signal and the location of the detector from the delay time of the response signal. They also permit the determination of the presence and the degree of a dangerous condition, such as the density of smoke, from the temporal duration of the response signal.

Such methods and apparatuses have the disadvantage that only the two parameters mentioned are available for signal transmission and therefore further information desired in the central signal station from the detectors cannot be transmitted without additional measures. The operational readiness and the correct functioning of the detector can therefore not be determined in the central signal station in this manner and the alarm system can give false alarms or unexpectedly fail to function.

A further disadvantage of such known devices is that the detectors have a relatively high energy consumption. When transmitting signals through electrical conductors, sufficient power for the energy supply of the individual detectors connected to the central signal station by the conductors is usually available. When a great number of detectors is connected to the central signal station in parallel by the same conductors or lines, as is often required in practice, the currents and the energy losses in the conductors can, however, assume values which make it difficult to assure a uniform energy supply for all detectors and such is no longer guaranteed.

Difficulties of this kind can be avoided by transmitting the signals in wireless communication, e.g. by means of electromagnetic radiation, such as radio waves or infrared radiation or by means of ultrasonic signals. The energy supply of the individual detectors is then usually provided by batteries in each detector. In order to attain the greatest possible longevity of such batteries and to assure a long-term operational readiness of such an alarm system of at least one year, the energy consumption of the detectors must be kept to a minimum and it is essential to monitor the operational state of the battery and thereby the functional state of the individual detectors continually and automatically in the central signal station. Defects must be located immediately and remedied. Hitherto known alarm systems cannot do this or have only a limited capacity to do so.

SUMMARY OF THE INVENTION

Therefore, with the foregoing in mind, it is a primary object of the present invention to provide a new and improved method and apparatus for reporting preferably dangerous but possibly also other conditions, which method and apparatus do not have associated with them the aforementioned drawbacks and shortcomings of the prior art constructions.

Another and more specific object of the present invention aims at providing a new and improved method and apparatus for transmitting signals in an alarm system of the previously mentioned type which permits interference-free signal transmission with the least possible energy consumption by the detectors and with simultaneous monitoring of the functionality and operational readiness of the detectors.

Yet another specific object of the present invention aims at providing a new and improved method and apparatus for signal transmission in an alarm system of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that the detectors transmit response signals after every $n^{th}$ interrogation signal when in an alarm state and the detectors transmit response signals only after every $m^{th}$ interrogation signal when in an operationally ready state and the alarm state is absent, wherein m and n are integers and m is greater than n.

The apparatus of the present invention is manifested by the features that the detectors are constructed for transmitting a a response signal after every $n^{th}$ interrogation signal received when in an alarm state and after every $m^{th}$ interrogation signal received when in an operationally ready state and when the alarm state is absent, and the central signal station further includes an evaluation device for generating an alarm signal after the transmission of a interrogation signals and the reception of at least x response signals from a given detector within the duration of the q interrogation signals and for generating an operational readiness signal after the transmission of q interrogation signals and the reception of at least y but less than x response response signals within the duration of a interrogation signals, where m, n, q, x and y are predetermined integers;

m is greater than n;

x is greater than y;

q is at least equal to x; and y is at least equal to 1.

In other words, the detectors, when they have detected a danger or are in an alarm state, transmit a response or status signal following every $n^{th}$ interrogation signal, where n is a predetermined whole number, and the detectors, when in a state of operational readiness and no danger has been detected, transmit a response or status signal following every $m^{th}$ interrogation signal, where m is a whole number greater than n.

It can be advantageous to select n=1, so that the detectors transmit a response or status signal following every interrogation signal when a dangerous condition or alarm state is present but in the absence thereof permit several interrogation signals to pass without response before giving a response, e.g. they respond only after every $5^{th}$ interrogation signal, so that the detectors report a dangerous condition or alarm state immediately and without delay, but in a normal state are in a waiting state with as low as possible a consumption of energy and the least possible demand on the battery, but nevertheless the operational state is periodically monitored at short time intervals and reported.

In one advantageous embodiment of the invention the detectors can be designed to respond to only every $p^{th}$ interrogation signal when their operational readiness is diminished, e.g. due to decreased battery tension, where p is greater than m, i.e. the detectors respond only at greater time intervals. In this manner, an incipient service failure of a detector can be recognized in advance and the battery can be exchanged and, furthermore, the battery is subjected to a lower demand when its voltage has waned.

The evaluation can be advantageously performed in the central signal station such that it can be determined for each detector from the arriving response or status signals, according to its characteristic individual time delay, how many response or status signals have been received during a given number q of interrogation signals. When the number is at least x, e.g. where there is a response signal reply to practically every interrogation signal, an alarm signal is generated and for a lower number y, an operational readiness signal is generated.

It has been found particularly advantageous for the interrogation and the response signals to comprise oscillation or pulse packets of given frequency and duration. This not only improves resistance to interference of the transmission but also permits the transmission of further parameters for transmitting additional information, e.g. the value of a measurement parameter characterizing a dangerous condition.

In principle, the invention can be employed in all known signal transmission methods, among others also in transmission over electrical conductors or lines or optical fibers. Particular advantages, for instance especially simple installation, are however obtained in wireless communication, for instance by means of radio waves or ultrasonic signals, and especially in communication by means of infrared radiation. The external interference so common with radio waves and ultrasonic signals can be avoided and, furthermore, when employing infrared radiation there are no governmental regulations which might restrict the application to be fulfilled. The high bandwidth of optical transmission permits a greater number of transmission channels than with other communication methods and therefore permits a greater number of detectors, up to more than 100, to be monitored from a single central signal station with a high degree of freedom from interference and in particularly simple manner with no installation expense and with an automatic monitoring of the functionality of the entire system.

BRIEF DESCRIPTION OF THE DRAWINGS

The invention will be better understood and objects other than those set forth above, will become apparent when consideration is given to the following detailed description thereof. Such description makes reference to the annexed drawings wherein through the various figures of the drawings there have been generally used the same reference characters to denote the same or analogous components and wherein.

DETAILED DESCRIPTION OF THE PREFERRED EMBODIMENTS

Figure 1:
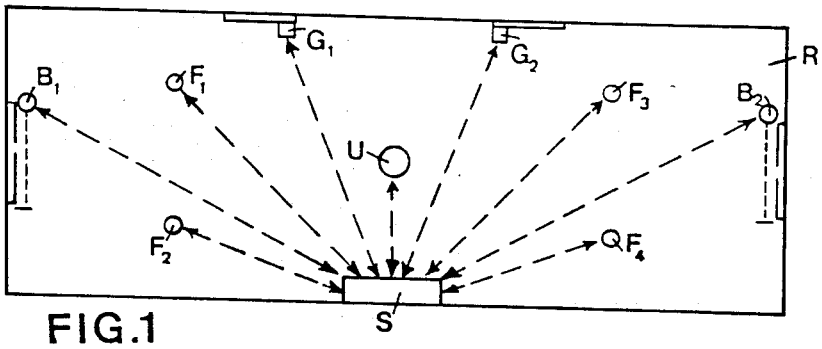
FIG. 1 shows a schematic plan view of a danger reporting system according to the invention.

Describing now the drawings, it is to be understood that to simplify the showing thereof only enough of the structure of the alarm system or installation has been illustrated as is needed to enable one skilled in the art to readily understand the underlying principles and concepts of this invention. The illustrated exemplary embodiment of the alarm system will be seen to comprise a device for monitoring a space or room R, for instance a warehouse floor, a factory bay or a large office space. A central signal station S is located in a central position, for instance on the long wall of the space or room R. Various types of detector or danger condition reporting devices are distributed over this space or room R corresponding to the risks to be expected. There are therefore fire detectors $F_1$, $F_2$ . . . $F_4$, for instance thermal, smoke or flame detectors, arranged at various points on the ceiling of the room or space R such that their monitoring region encompasses the entire room or space. There are intrusion detectors $B_1$, $B_2$ at the entrances, which, for instance, may be constructed as visible light or infrared radiation detection barriers or gates, as door contacts or as vibration sensors. Glass breakage alarms $G_1$, $G_2$ are installed at the windows and there is a motion alarm U located at a central position in the room which, for instance, can be constructed as an infrared body radiation alarm or as a Doppler effect ultrasonic alarm.

This arrangement can be furthermore provided with a day/night commutation switch which switches certain alarms, for instance the intrusion alarms $B_1$, $B_2$ and the motion alarm U, off during daylight hours, while all of the alarms are active at night. The individual alarms or detectors consume as little power as possible and are constructed with battery power supplies.

All alarms or detectors are in communication with the central signal station S by means of a definite signal transmission means. This means can comprise electrical conductors or lines. However, to avoid the effort and expense of installation, especially for a multiplicity of sensors or detectors to be monitored by the same central signal station, it is more advantageous to provide a wireless communication system. It must be borne in mind that the system must be sensitive neither to external interference, such as ultrasonic systems often are, nor itself generate interference in the surrounding environment or in other systems, as most radio waves often do, and its range must be limited as far as possible to the specific zone of protection, while providing an adequate number of transmission channels for a multiplicity of sensors or detectors.

The communication or transmission means or system must be selected corresponding to the particular application. Although other communication or transmission means may be quite suitable in many cases, it has been found that signal transmission by means of infrared radiation is particularly advantageous for meeting all requirements in applications where conditions for signal transmission are particularly difficult.

The central signal station S in the exemplary embodiment illustrated is therefore arranged to periodically transmit interrogation or scan signals in the form of infrared radiation at prescribed time intervals simultaneously to all detectors. The individual detectors are either located in direct visual contact with the central signal station S and receive the interrogation signals directly or they receive them indirectly by reflection from the walls or from special reflectors and transmit response or status signals to the central signal station according to the momentary condition or state of the detector also in the form of infrared radiation which is evaluated in the central signal station to be displayed as an alarm report.

According to the invention, each detector transmits its response or status signal only after a predetermined time delay, which is characteristic of the corresponding detector, after reception of the interrogation or scan signal. The individual response or response signals are therefore temporally shifted in relation to the interrogation signals and follow one another in different time intervals between two interrogation signals, so that the time difference between the interrogation and the response signal can be detected in the central signal station and used to determine the source of the response or status signal and the corresponding detector localized.

The individual detectors comprise specific sensors for the phenomenon to be monitored. Each such sensor controls the transmission of the response or status signal such that in the normal case when no danger condition exists, i.e. no smoke or motion is detected in the room being monitored, the response or status signals are suppressed for a predetermined time or until a predetermined number of interrogation or scan signals have occurred or a response or status signal is given only after every $m^{th}$ interrogation signal, for instance after every $5^{th}$ interrogation signal. However, in case of danger, for instance when smoke develops or when there is unauthorized intrusion into the room, a response or status signal is generated after every $n^{th}$ interrogation signal, i.e. more often than under normal conditions.

n is advantageously chosen to be equal to 1, that is in the case of danger the corresponding detector generates a response or status signal for every interrogation signal. This has the further advantage that under normal conditions energy is consumed only by the relatively seldom transmission of a response or status signal, but in the case of danger an alarm is given without temporal delay. The battery required for the individual power supply of each detector in wireless transmission of signals is therefore loaded as little as possible and the detectors permit a particularly great service longevity without having to replace the battery.

In one advantageous embodiment of the invention response signals are transmitted even less often as the battery potential slowly diminishes, for instance only after $p^{th}$ interrogation signal, for instance instead of after every $5^{th}$ only after every $10^{th}$ interrogation signal. This greater time interval of the response or status signals can be evaluated in the central signal station to indicate an incipient battery failure or operationally impaired state, so that the depleted battery can be replaced in good time. A total battery failure, a detector defect or attempted sabotage can be determined in the central signal station on the basis of a total absence of response or status signals from a given detector.

Figure 2:
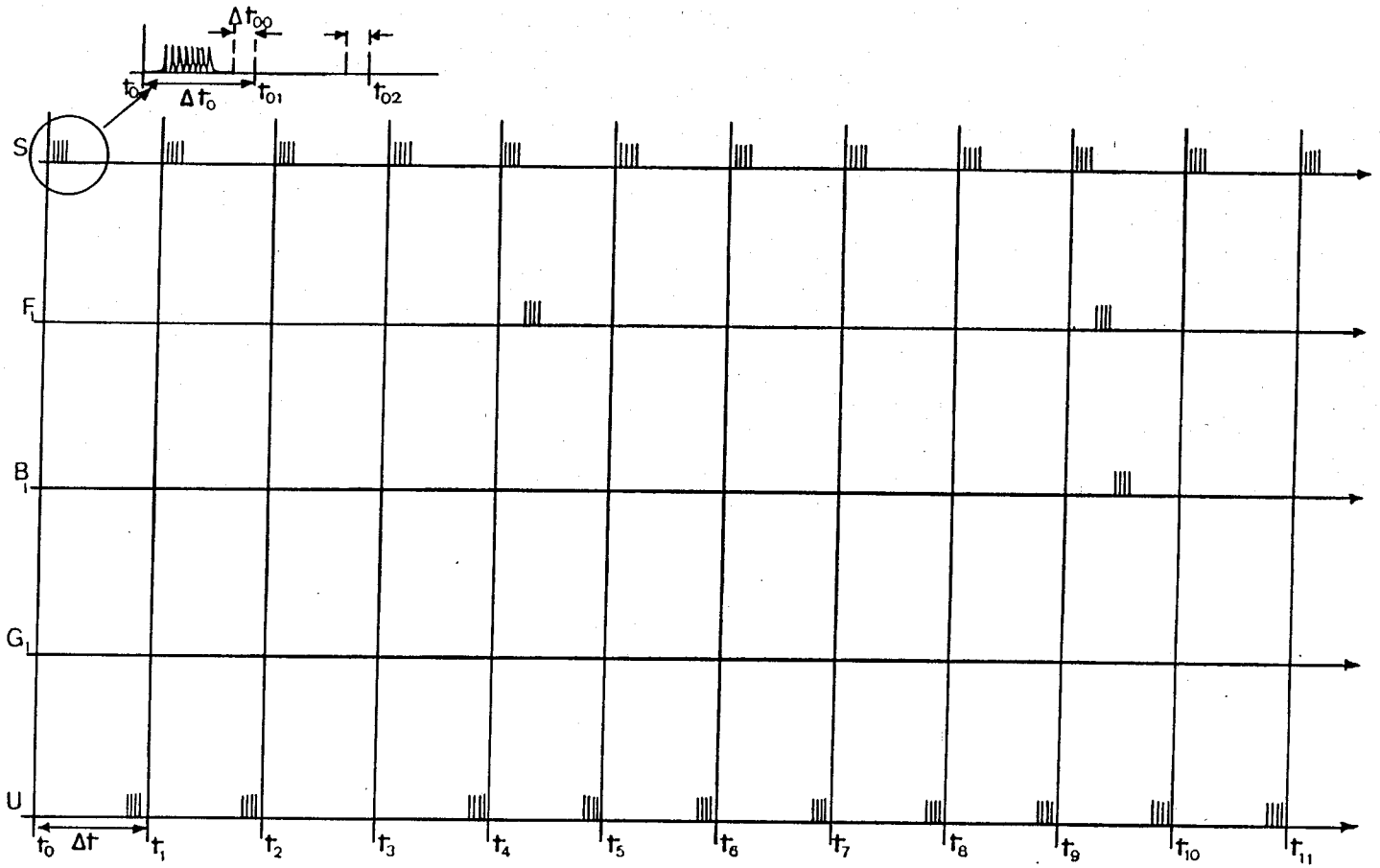
FIG. 2 shows a signal timing diagram for explaining the method.

FIG. 2 shows a timing diagram of the interrogation or scan signals transmitted by the central signal station S and the response or status signals transmitted back by four selected detectors $F_1$, $B_1$, $G_1$, U in the case of a presumed danger condition. The central signal station S periodically transmits interrogation signals at prescribed times $t_0$, $t_1$, $t_2$ . . . , for instance at time intervals $\Delta t$ of about one second. These comprise, as is illustrated on an enlarged scale for the first interrogation signal, an oscillation or pulse packet having a frequency of about 30 to 100 kHz and a duration of about 1 to 10 milliseconds which lies within the time interval $\Delta t_0$ prescribed for the interrogation signal between $t_0$ and $t_{01}$ of about 3 to 30 milliseconds duration. The subsequent time intervals $t_1$–$t_2$, $t_2$–$t_3$ . . . , are reserved for the temporally shifted response or status signals of the individual detectors and have an analogous time duration of 3 milliseconds with safety spacings $t_{00}$ of about 1–10 milliseconds duration between the time intervals for the individual signals in order to avoid interference between various detectors and to accommodate inevitable tolerances of the components employed.

In this manner, about 250 channels can be created for the simultaneous monitoring of detectors, wherein the state of each detector can be individually and independently determined in the central signal station. It can be advantageous for a rational evaluation to group the detectors together according to their type or to their location, for instance to reserve the first 25 channels for fire detectors, the next 25 for intrusion detectors and so forth, or, on the other hand, 25 channels each for each of 10 subdivisions of the room to be monitored.

The remainder of the diagram shows the response or status signals for four selected detectors in different operating states. The first detector $F_1$, for instance a fire detector, transmits a response or status signal after every $5^{th}$ interrogation or scan signal with its own characteristic time delay. This is interpreted in the central signal station as an absence of a danger condition, i.e. the absence of fire or a normal state and operationally ready state. The second detector $B_1$, for instance an intrusion detector, supplies a response or status signal only after every $10^{th}$ interrogation signal. This indicates that, while no danger condition exists, the battery of this detector is depleted and urgently needs to be exchanged, i.e. has assumed an operationally impaired state. The third detector $G_1$, for instance a glass breakage detector, supplies no response signal at all, which means that this detector is out of operation, for instance due to the failure of components or to sabotage. The fourth detector U, for instance a motion detector, transmits a response or status signal after every interrogation or scan signal. This indicates that an alarm or danger state exists, such as would be due to an unauthorized person moving about in the monitored room. Individual response or status signals may be lacking for any reason, as indicated at time $t_3$ in the diagram. Advantageously, the central signal station performs its evaluation while taking such gaps into consideration and even supplies an alarm signal when individual response or status signals are skipped.

Figure 3:
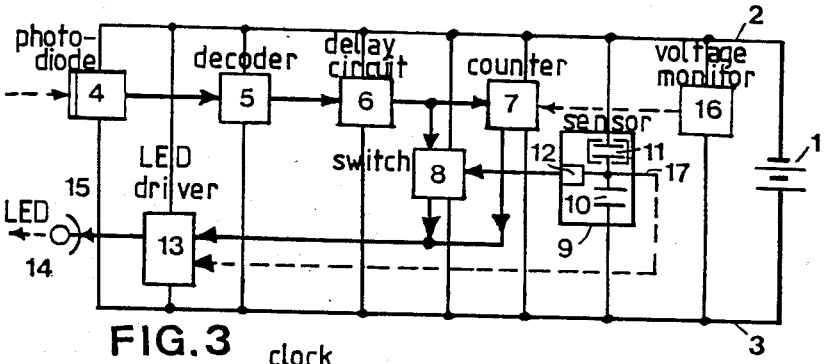
FIG. 3 shows a block circuit diagram of a detector.

FIG. 3 shows an exemplary embodiment of a possible circuit for a detector. The various components of the detector are supplied with a direct-current voltage of about 9 volts by a battery 1 through the conductors or leads 2 and 3. A photodiode 4, for example a Siemens BP 104 type photodiode with a maximum sensitivity at a wave length of 950 nanometers, receives the infrared radiation transmitted by the central signal station and conducts it to a decoder circuit 5 which delivers a trigger signal when the arriving interrogation signal has the correct form, i.e. duration and frequency. The trigger signal activates a time-delay circuit 6 which delivers an output signal after a predetermined time interval has passed. The time delay can be adjustable and is different for each detector.

The time-delay output signal is conducted to a digital counter 7 which transmits an output pulse after a predetermined and selected number m of arriving trigger pulses, for instance after every $5^{th}$ pulse. The digital counter 7 is short-circuited by an electronic switch 8 which is controlled by a sensor 9 such that it closes and short-circuits the counter 7 when the sensor 9 has detected a dangerous condition or state but remains open in the normal state. Thus, in an alarm state every trigger pulse is conducted and in the normal state only every $5^{th}$ pulse.

In the exemplary embodiment illustrated, the sensor 9 is constructed as two different smoke-sensitive ionization chambers 10 and 11 arranged in series. The potential at the terminals of both ionization chambers 10 and 11, which is characteristic of the smoke density, is converted by a threshhold detector or switch 12, for example a MOSFET, into a digital signal which controls the electronic switch 8.

The output pulses of the counter 7 or of the electronic switch 8 arrive at the input of a LED-driver circuit 13 which contains its own battery and induces a light-emitting diode 14, for instance a Siemens LD 271 type LED with a radiation maximum at 950 nanometers, to transmit a response signal in the form of a pulse packet having a different pulse frequency and perhaps also a different pulse duration than the interrogation signal. Optical focusing means 15 can be provided for directing the radiation to the receiver in the central signal station. The time difference between the interrogation signal and the response signal depends upon the delay time of the time-delay circuit 6.

A voltage sensor 16 can be additionally provided in parallel to the battery 1 of the power supply or in parallel to the battery of the LED-driver circuit 13, or both, which switches the counter 7 from a value m to a higher value p, for instance 10, when the battery voltage falls below a prescribed value. This means that the corresponding detector with diminished battery voltage replies to only every $10^{th}$ interrogation signal instead of every $5^{th}$. The voltage sensor 9 can be further provided with an analog output 17 controlling the LED-driver circuit 13, for instance to alter the frequency or duration of the pulse packet of the output signal to give a supplementary indication of the value of a measured detection parameter, such as the value of smoke density detected.

Figure 4:
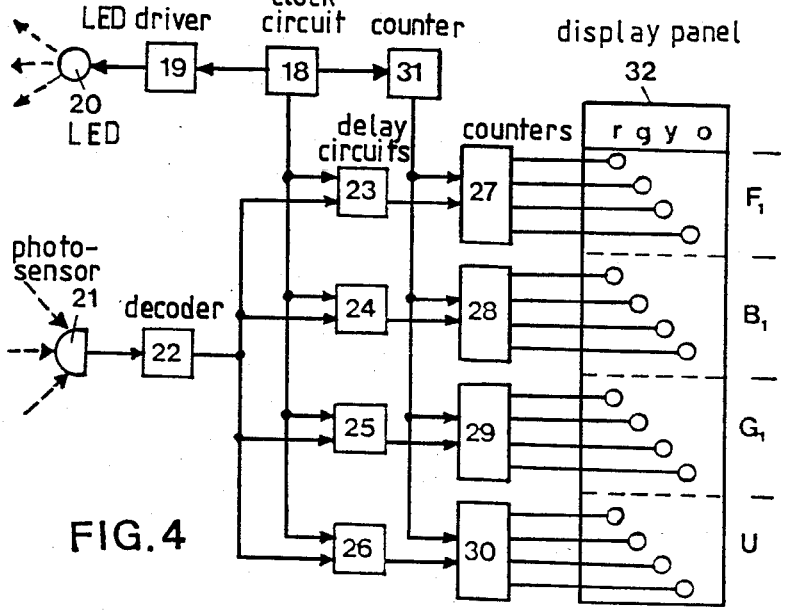
FIG. 4 shows a block circuit diagram of a central signal station.

In the exemplary embodiment of the circuit of a central signal station represented in FIG. 4, a clock or timing circuit 18 which periodically transmits a control pulse at intervals of about one second is provided. A LED-driver circuit 19 induces one or more light-emitting diodes 20, which may also be Siemens LD 271 type LED'S, to periodically transmit interrogation signals in the form of pulse packets. The pulse frequency must be sufficiently different from that of the response signal so that no mutual influence or interference of the detectors by the response signals can occur. The radiation arriving from the detectors can be picked up by a photodetector 21, which may also be a BP 104 type photodetector, and conducted to a decoder circuit 22 which only transmits the signal when it has the prescribed form or frequency. If such is the case, the signals are conducted to a series of parallel time-delay circuits 23, 24, 25 and 26 which are simultaneously controlled by the clock or timing circuit 18 and only transmit a signal when it arrives within a prescribed time interval following a clock or timing pulse. These time intervals are variously chosen for the individual time delay circuits 23, 24, 25 and 26, so that the individual intervals do not overlap and a number of temporally shifted evaluation channels are established, only four of which are illustrated but whose number may amount to several hundred in practice.

If a response signal arrives during the open or transmitting interval of one of the time-delay circuits 23, 24, 25 and 26, then such time-delay circuit transmits it to an associated digital counter 27, 28, 29 and 30. A further counter 31 controlled by the clock or timing circuit 18 delivers a trigger signal after every $q^{th}$ clock or timing pulse to these digital counters 27, 28, 29 and 30 which resets them. The count or counter state of the digital counters is displayed individually for the individual detectors on a display panel 32 at the subsequent reset pulse. In the embodiment illustrated there is provided a display, for four different detectors $F_1$, $B_1$, $G_1$, and U. If the number of response signals z registered within the evaluation time is either 9 or 10, a danger signal r (red light) is indicated, if the counter state is between 4 and 8, operational readiness g (green light) is indicated; if the number is between 1 and 3, battery depletion y (yellow light) is indicated and if there is a complete lack of signals, failure indication o (orange) is indicated. In addition to the display on the display panel 32 of the central signal station, circuits can be provided which automatically transmit a danger signal or alarm to the police or fire departments or which initiate protective and remedial measures according to the type of detector responding.

The individual detectors can also be locally supplied with power from the mains circuit while the signals are still transmitted in wireless communication, for instance by optical means. This can save expensive installation work for signal conductors. It is also conceivable to employ the mains wiring for transmitting the signals in the form of high-frequency pulse packets instead of separate signal conductors.

For the simultaneous monitoring of several rooms, a substation can be provided in each room which monitors several detectors. The individual substations can be connected to a common central signal station which processes and displays the signals of the entire system.

It will be understood that modifications of the embodiments of the detectors or of the central signal station are possible within the framework and teachings of the invention. Such modifications lie within the scope of the ability of one skilled in the art when he or she is in possession of the basic principles of the invention. It is, for instance, possible to employ integrated circuits with the same function instead of discrete components. It is also possible to employ a time-multiplex method instead of separate channels or employ a microprocessor programmed according to the method of the invention in which the response signals are stored in corresponding memories or storages according to delay time and the state of the entire system, especially all abnormal conditions of the alarms or detectors with indication of the location and the type of alarm state, can be displayed on a video screen or can be printed on a printer upon periodical evaluation of the of all memories or storages.

It is of particular advantage for the method described that the central signal station need only determine the presence of a pulse packet of a given frequency and duration and need not distinguish individual bits. In this way, the power consumption of the LED-driver circuits for the response or status signal transmitters can be reduced or the range of communication can be considerably increased with the same power output. For instance, experiments have shown that in a system of the type described with optical signal transmission in the absence of strong optical interference radiation, ranges up to more than 100 meters are obtainable, and in the presence of strong sunlight ranges of 20 meters can still be attained without the arisal of interference and with a service longevity of at least one year when using C-size batteries in the LED-driver circuits.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A method of signal transmission and signal processing in an alarm system comprising a central signal station and remotely located detectors, comprising the steps of:

transmitting an interrogation signal to said detectors from said central signal station;

transmitting response signals from said detectors after a time delay characteristic of each individual detector back to the central signal station after receiving said interrogation signal;

said response signals corresponding to a current state of the individual detector;

receiving and evaluating the response signals at the central signal station;

the detectors transmitting the response signals after every $n^{th}$ interrogation signal when in an alarm state; and the detectors transmitting response signals only after every $m^{th}$ interrogation signal when in an operationally ready state and the alarm state is absent;

wherein;

m and n are integers; and m is greater than n.

2. The method as defined in claim 1, wherein:

said detectors transmit said response signals only after every $p^{th}$ interrogation signal when in an operationally impaired state;

wherein;

p is an integer greater than m.

3. The method as defined in claim 1, wherein:

$n=1$ and said detectors transmit said response signals after every interrogation signal when in an alarm state.

4. The method as defined in claim 1, wherein:

said interrogation signals and said response signals comprise packets of pulses of a predetermined frequency and duration.

5. The method as defined in claim 4, wherein:

said predetermined frequency of said pulses of said packets of said response signals depends upon a measurement value characteristic of a condition to be detected.

6. The method as defined in claim 4, wherein:

said predetermined duration of said pulses of said packets of said response signals depends upon a measurement value characteristic of a condition to be detected.

7. The method as defined in claim 1, wherein:

said central signal station evaluates the response signals received such that after the transmission of q-interrogation signals and the reception of at least x-response signals from a given detector within the duration of the q-interrogation signals an alarm signal is given and such that after the transmission of q-interrogation signals and the reception of at least y but less than x-response signals from a given detector within the duration of the q-interrogation signals an operationally ready signal is given;

wherein:

q, x and y are integers; and x is greater than y.

8. The method as defined in claim 1, wherein:

said central signal station transmits said interrogation signals to said detectors and the detectors transmit said response signals back to the central signal station by wireless communication means.

9. The method as defined in claim 8, wherein:

said wireless communication means comprises infrared radiation.

10. The method as defined in claim 9, wherein:

said wireless communication means comprises infrared radiation focused by optical focusing means.

11. A device for reporting danger or other desired conditions comprising:

a central signal station;

detectors remotely located from said central signal station;

said central signal station including at least one signal transmitter for transmitting interrogation signals;

each of said detectors comprising:

a signal receiver for receiving said interrogation signals;

a signal transmitter for transmitting response signals;

a sensor for influencing said response signals;

delay means for temporally delaying the transmission of the response signals in relation to the reception of a interrogation signal by different delay times characteristic of each individual detector;

said central signal station further including:

a signal receiver for receiving the response signals transmitted by the individual detectors;

said detectors being constructed for transmitting a response signal after every $n^{th}$ interrogation signal received when in an alarm state and after every $m^{th}$ interrogation signal received when in an operationally ready state and the alarm state is absent; and the central signal station further including an evaluation device for generating an alarm signal after the transmission of q-interrogation signals and the reception of at least x-response signals from a given detector within the duration of the q-interrogation signals and for generating an operational readiness signal after the transmission of q interrogation signals and the reception of at least y but less than x-response signals within the duration of the q-interrogation signals;

wherein:

m, n, q, x and y are predetermined integers;

m is greater than n;

x is greater than y;

q is at least equal to x; and y is at least equal to 1.

* * * * *

UNITED STATES PATENT AND TRADEMARK OFFICE

CERTIFICATE OF CORRECTION

PATENT NO. : 4,551,710

DATED : November 5, 1985

INVENTOR(S) : ALAN TROUP, HANNES GüTTINGER and GUSTAV PFISTER

It is certified that error appears in the above—identified patent and that said Letters Patent is hereby corrected as shown below:

Column 2, line 63, please delete "a" in the first occurance
Column 3, line 1, please delete "a" and insert --q--
Column 3, line 6, please delete "response" in the first occurance
Column 3, line 7, please delete "a" and insert --q--

Signed and Sealed this

*Twenty-fifth* Day of *March 1986*

[SEAL]

*Attest:*

DONALD J. QUIGG

*Attesting Officer*

*Commissioner of Patents and Trademarks*